US005822667A

United States Patent [19]

Hayama et al.

[11] Patent Number: 5,822,667

[45] Date of Patent: Oct. 13, 1998

[54] TRANSFER SEPARATOR

[75] Inventors: Yuko Hayama, Kohoku-ku; Hirokazu Ishii, Akabane-nishi; Satoshi Takano, Bunkyo-ku; Akio Kutsuwada, Miyamae-ku; Hakuti Mizuishi, Shinjyuku-ku; Hiroshi Itoh, Komatsubara; Itaku Matsuta, Izumi-ku, all of Japan

[73] Assignee: Ricoh Company, Ltd., Tokyo, Japan

[21] Appl. No.: 676,524

[22] Filed: Jul. 2, 1996

[30] Foreign Application Priority Data

Jul. 3, 1995 [JP] Japan ..... 7-167496
Nov. 8, 1995 [JP] Japan ..... 7-289681

[51] Int. Cl.[6] ..... G03G 15/16

[52] U.S. Cl. ..... 399/314; 399/313

[58] Field of Search ..... 399/297, 303, 399/310, 311, 312, 313, 314, 315, 318

[56] References Cited

U.S. PATENT DOCUMENTS 5,386,274 1/1995 Sanpe et al. ..... 399/312 X
5,469,248 11/1995 Fujiwara et al. ..... 399/314
5,495,317 2/1996 Matsuda et al. ..... 399/313 X
5,552,871 9/1996 Kutsuwada et al. ..... 399/313
5,557,384 9/1996 Takano et al. ..... 399/313
5,559,590 9/1996 Arai et al. ..... 399/314

FOREIGN PATENT DOCUMENTS 3-62077 3/1991 Japan .
3-62078 3/1991 Japan .
3-62079 3/1991 Japan .

*Primary Examiner*—Sandra L. Brase
*Attorney, Agent, or Firm*—McDermott, Will & Emery

[57] ABSTRACT

A transfer separator comprises a transfer belt or other transfer mechanism for carrying and conveying a sheet to apply a toner image from an image carrier onto the sheet and separating the sheet from the image carrier. A bias application electrode applies a transfer bias to the transfer belt, wherein a relation of $Lp \geqq aV$, and a=1 mm/KV is established when the minimum distance between the image carrier and surface of the bias application electrode is set to Lp (mm) and the maximum voltage applied to the bias application electrode is set to V (KV) . Preferably, the bias application electrode has a coated layer, and the difference in thickness resistance between the coated layer and the transfer belt is within two orders of magnitude. The hardness of the coated layer is preferably equal to or greater than the hardness of the transfer belt.

13 Claims, 9 Drawing Sheets

TRANSFER SEPARATOR

TECHNICAL FIELD

The present invention relates to a transfer separator which is used in an image forming apparatus such as a copying machine, a facsimile machine, a printer or the like.

BACKGROUND ART

In an image forming apparatus such as a copying machine, a facsimile machine, a printer or the like, an image is formed on an image carrier which comprises photosensitive drums and transferred on a sheet, such as a transfer paper or the like, with a transferring device, and then the image on the sheet is fixed with a fixing device. Embodiments of a transferring device are a contact transfer means which uses a transfer belt, a non-contact transfer means which uses a corona discharger and the like.

As compared with the non-contact transfer means, the contact transfer means has an advantage in that the generation of ozone is little, power source capacity is small, and sheet separation and carriage performance (performance of separating and carrying a sheet from an image carrier after an image is transferred) is favorable. In the transfer separator which uses a transfer belt, the transfer belt is pressed by a contact separation mechanism to contact an image carrier during image transfer. At the same time, the transfer belt is rotationally driven by a driving means and transfer bias is applied from a high voltage power source via a bias application electrode to electrostatically carry and convey the sheet. Then the sheet is separated from the image carrier after a toner image on the image carrier is transferred onto the sheet.

Japanese Unexamined Patent Application No. HEI 3-62077 Publication describes an electrostatic recorder which has a belt roller type transfer separation part for pressing an endless-shaped high resistance transfer member conveying belt in a direction of an image carrier with an electrode roller to allow the transfer member to proceed between the transfer member conveying belt and image carrier so that a toner image on the image carrier is transferred onto the transfer member. The surface of the electrode roller comprises an elastic member having a resistance value represented by a volume resistance ratio of $10^5$ to $10^{10}$ Ωcm, and the hardness of the elastic member is set to 30 to 60 degrees.

Japanese Unexamined Patent Application No. HEI 3-62078 Publication describes an electrostatic recorder which has a belt roller transfer type transfer separation part for pressing an endless-shaped transfer member conveying belt in the direction of an image carrier by an electrode roller to allow a transfer member to proceed between the transfer member conveying belt and electrode roller so that a toner image on the toner image carrier is transferred onto the transfer member. A voltage applied to the image carrier is switched in accordance with the kind of transfer member so that a constant load is applied to the transfer member.

Japanese Unexamined Patent Application No. HEI 3-62079 Publication describes an electrostatic recorder which has a belt roller transfer type transfer separating part for pressing an endless-shaped high resistance transfer member conveying belt in the direction of an image carrier by an electrode roller to allow a transfer member to proceed between the transfer member conveying belt and image carrier so that a toner image on the image carrier is transferred onto transfer member. A different roller is arranged on the inflow side of the image carrier, and the transfer member conveying belt is spanned to the different roller so that the transfer member conveying belt proceeds approximately from a tangential direction with respect to the image carrier and the electrode roller.

Further, there is proposed a belt transfer apparatus which provides a transfer belt which is supported by a driving roller and a follower roller, and a transfer bias electrode which contacts the transfer belt to apply a transfer bias voltage. The belt transfer apparatus applies a voltage to the transfer bias electrode while rotating the transfer belt to electrically transfer a toner image on the image carrier onto transfer paper on the transfer belt. The transfer bias electrode has at least a two-layer structure, and a volume peculiar resistance of a surface layer which contacts the transfer belt is higher than that of an adjacent lower layer.

Since the transfer belt allows the transfer belt to contact the image carrier during image transfer in the transfer separator, a transfer bias voltage applied to the transfer belt from the high voltage power source via a bias application electrode may cause an abnormal discharge (leakage) from the transfer belt to the image carrier. This means that when there is a defect such as pin holes or the like particularly in the transfer belt and the image carrier, abnormal discharge is caused, an abnormal state is generated in an image on the sheet and noise caused by the discharge may sometimes generate an error in the operation of the device.

DISCLOSURE OF THE INVENTION

An object of the present invention is to provide a transfer separator which is capable of securing a stable condition of a transfer nip and preventing changes in resistance caused by a bleed of the bias application electrode.

To attain the aforementioned object, the invention provides a transfer separator which has a transfer belt for carrying and conveying a sheet to transfer a toner image on an image carrier onto the sheet and separating the sheet from the image carrier, and a bias application electrode for applying a transfer bias to this transfer belt, wherein the relations of $Lp \geqq aV$, and $a = 1$ mm/KV are established when a minimum distance between aforementioned image carrier and a surface of aforementioned bias application electrode is set to Lp (mm) and a maximum voltage applied to aforementioned bias application electrode is set to V (KV).

The invention according to a preferred embodiment provides a transfer separator wherein the maximum voltage applied to the bias application electrode is determined by a limiter.

In accordance with another aspect, the invention provides a transfer separator which has a transfer belt for carrying and conveying a sheet to transfer a toner image on an image carrier onto the sheet and separating the sheet from the image carrier, and a bias application electrode for applying a transfer bias to this transfer belt. The bias application electrode preferably has a coated layer, and the difference in resistance between the coated layer and the transfer belt is set to within two orders of magnitude.

The invention according to another aspect establishes the hardness of the coated layer is equal to or greater than that of the transfer belt.

The invention according to a further aspect provides separation of the bias application electrode from the transfer belt except during transfer.

BEST MODE FOR CARRYING OUT THE INVENTION

Figure 1:
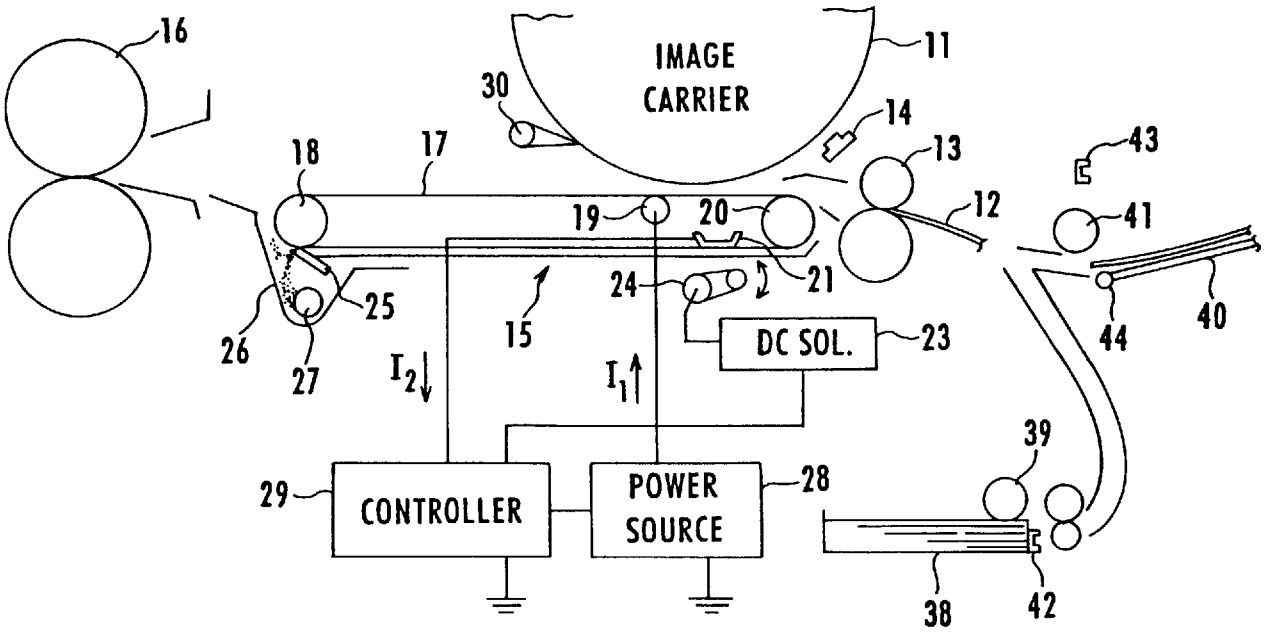
FIG. 1 is a schematic view showing a waiting state of a first embodiment according to the present invention.
Figure 2:
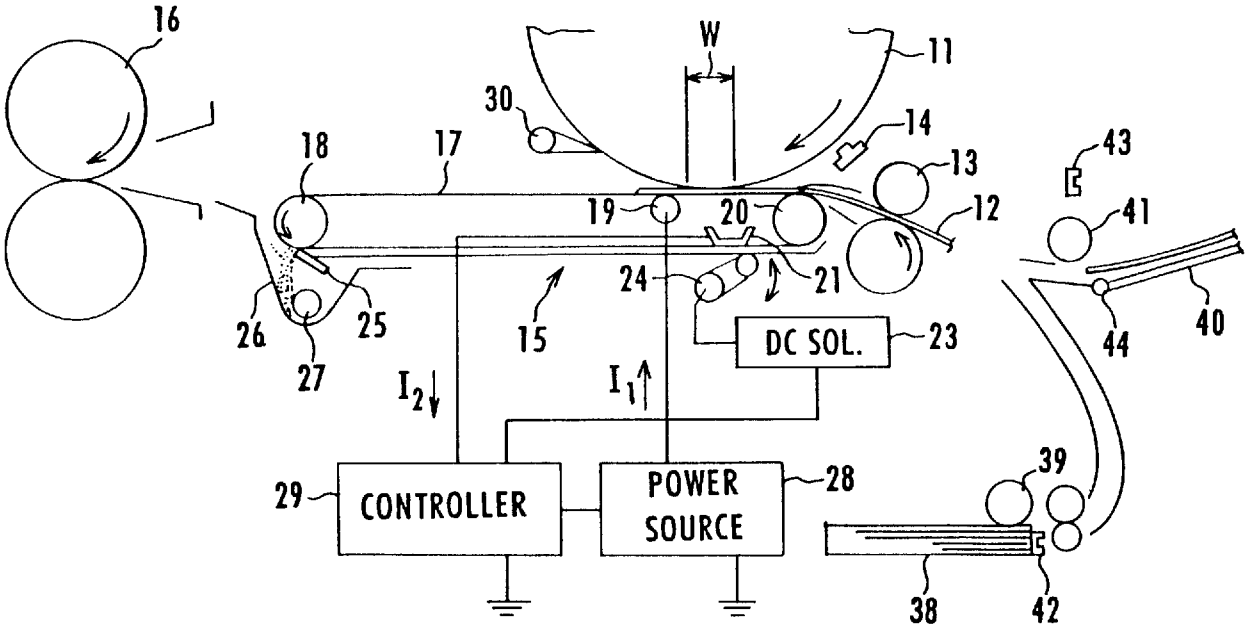
FIG. 2 is a schematic view showing a paper feeding state according to a first embodiment of the present invention.

Referring to FIGS. 1 and 2, the first embodiment of the invention is depicted within the environment of an image forming apparatus such as a copying machine or the like. When an image is formed on one side of a transfer paper in this image forming apparatus, an image carrier 11 which comprises a photosensitivity body, such as a photosensitive drum, is rotationally driven by a driving element and the image carrier is uniformly charged by a charger, which is not shown, and thereby an electrostatic latent image is formed by image exposure from an exposure device and the electrostatic latent image is developed to a toner image by a developer.

In addition, a transfer paper 12 is fed by a paper feed roll 39 from a paper feeding device 38 which comprises a paper feeding tray and is set in a waiting state before a resist roller 13, or, a transfer paper manually inserted from a manual insertion base 40 is fed by a paper feed roll 41 and set in a waiting state before the resist roller 13. The image forming apparatus is constituted so that the size of the transfer paper fed from the paper feeding device 38 or the manual insertion base 40 is detected at least in a direction vertical to a sheet traveling direction by size detecting means 42 and 43 and the manual insertion base 40 is rotationally opened and closed around a shaft 44.

The resist roller 13 feeds out the transfer paper 12 with the timing of the toner image on a photosensitive drum 11. The photosensitive drum 11 is illuminated by a pretransfer neutralizing lamp 14 after the electrostatic latent image is developed, so that its surface potential is lowered. After that, the toner image on the photosensitive drum 11 is transferred onto the transfer paper 12 by the transfer separator 15. The transfer paper 12 is separated from the photosensitive drum 11 after the toner image on the photosensitive drum 11 is transferred by the transfer separator 15, so that toner on the transfer paper 12 is fixed by a fixing device 16. Residual toner on the photosensitive drum 11 is removed by a cleaning device after the toner image is transferred.

In a dual side mode in which images are formed on both sides of a transfer paper, the transfer paper 12 is conveyed along a conveyance channel, not shown, and discharged to a dual side tray after a toner image is transferred and fixed by an operation similar to that for one-side image forming on the surface of the transfer paper 12. The transfer paper 12 is fed again from the dual side tray in an inverted state and sent to the resist roller 13. On the rear surface of the transfer paper which is fed again, another toner image is transferred and fixed by an operation similar to that for one-side image forming.

Further, in a synthesis mode in which images are formed repeatedly on the same surface, the transfer paper 12 is conveyed along the conveyance channel, not shown, and sent to a resist roller 13 after a tone image is transferred and fixed on the surface of the transfer paper 12 by an operation similar to that described above. On the surface of the transfer paper 12 which is sent to this resist roller 13, another toner image is transferred and fixed by an operation similar to that described above.

The transfer separator 15 provides an endless-shaped transfer belt 17 which comprises an elastic dielectric member, a driving roller 18 for rotationally driving this transfer belt 17; a bias application electrode 19 which comprises a bias roller, which is arranged on an internal periphery of the transfer belt 17 so as to contact the transfer belt 17 downstream the photosensitive drum 11 along the rotating direction of the transfer belt 17, for applying a transfer bias to the transfer belt while a contact width W of the transfer belt 17 and the photosensitive drum is kept; a follower roller having a taper provided on both ends for preventing the transfer belt 17 from deviating; a ground electrode 21 comprising a contact plate which contacts the transfer belt 17 for allowing current to flow to the ground side from the transfer belt 17; a direct current solenoid 23 which is operated with a signal from a controller 29; a push-up lever 24 which is driven by the direct current solenoid 23 to allow the transfer belt 17 to contact the photosensitive drum 11; a cleaning blade 25 for cleaning a surface of the transfer belt 17; a toner receiving element 26 for receiving toner and paper particles which are scratched from the surface of the transfer belt 17 with this cleaning blade 25; a recycling coil 27 for conveying toner and paper particles in the toner receiver 26 to the recycle bottle of the main body; and a high voltage power source 28, wherein the transfer belt 17 is spanned between the driving roller 18 and the follower roller 20.

In the transfer separator 15, during the waiting time the direct current solenoid 23 is off, the transfer belt 17 is separated from the photosensitive drum 11, as shown in FIG. 1, and the high voltage power source 28 does not apply a transfer bias to the bias roller 19.

When feeding paper, as shown in FIG. 2, the transfer paper 12, which is fed from the paper feeding device to the resist roller 13 and placed in a waiting state, is sent out with the timing of an image on the photosensitive drum 11 by the resist roller 13. When the end of the transfer paper 12 comes close to a contact part of the photosensitive drum 11 and the transfer belt 17, the direct current solenoid 23 is operated with a signal from the controller 29 to drive the push-up lever 24, and the push-up lever 24 pushes up the transfer belt 17 to contact the photosensitive drum 11. At this time, a transfer nip having a width of 4 mm to 8 mm is formed on the contact part of the transfer belt 17 and the photosensitive drum 11.

When the transfer belt 17 is rotationally driven by the driving roller 18 and the transfer paper 12 proceeds into the transfer nip having a width W between the transfer belt 17 and the photosensitive drum 11, a transfer bias is applied from the high voltage power source 28 to the bias roller 19 with a result that an electric charge having a polarity opposite that of toner on the photosensitive drum 11 is applied to the transfer belt 17, and toner on the photosensitive drum 11 is transferred to the transfer paper 12.

In this first embodiment, the surface of the photosensitive drum 11 is charged with −800 V by a charger, and an electrostatic latent image is developed with toner which is charged with a plus voltage after exposure by a developer. Then the surface potential of the photosensitive drum 11 is reduced by illumination with the pretransfer neutralizing lamp 14. Next the high voltage power source 28 applies a transfer bias voltage of −1 KV to −5 KV to the bias roller 19 and toner on the photosensitive drum 11 is transferred to the transfer paper 12 on the transfer belt 17. Incidentally, minus symbols in the current and voltage values are omitted hereinafter. The transfer belt 17 receives an electric charge by the application of a transfer bias and carries and conveys the transfer paper 12 by electrostatically adsorbing the transfer paper 12, and the transfer paper 12 is separated from the photosensitive drum 11 after toner on the photosensitive drum 11 is transferred to the transfer paper 12. If the transfer paper 12 remains adsorbed by the photosensitive drum 11, the transfer paper 12 is separated from the photosensitive drum 11 with a separation claw 30 and conveyed by the transfer belt 17.

For the transfer belt 17, belts A, B and C are used, which have a surface resistivity (for example, JISK6911) of $1\times10^9$ Ω/□ to $1\times10^{12}$ Ω/□ on the side contacting the photosensitive drum 11 and $1\times10^7$ Ω/□ to $1\times10^9$ Ω/□ on the inside contacting the bias roller 19. Electric charge applied to the transfer belt 17 and the transfer paper 12 is cancelled by the contact plate 21 as the transfer belt 17 moves downstream the rotating direction of the transfer belt 17.

The surface of the transfer belt 17 is made of a fluorine material, so the friction coefficient of the surface is low and cleaning can be stably performed. In addition, the reason why the surface material of the transfer belt 17 has a higher resistance than the material used for the inside of the transfer belt 17 is to prevent a true electric charge of transfer from directly flowing into the transfer paper which is moisture adjusted under a high moisture conditions so as to avoid an imperfect separation of the transfer paper from the photosensitive drum 11. Specifically, as material for the inside of the transfer belt 17, a rubber material such as a chloropuren rubber, an EPDM rubber, a silicone rubber, an epichlorohydrin rubber or a blended material thereof is used, and, as the fluorine material used for the surface of the transfer belt 17, polyvinylidene fluoride, tetrafluoroethylene or the like is coated to a thickness of 5 to 15 μ together with a dispersion material. The transfer paper 12 on the transfer belt 17 is separated from the transfer belt 17 by curvature separation due to the bow of the transfer paper 12 at the driving roller 18 and toner is fixed by the fixing device 16.

When current supplied from the high voltage power source 28 to the bias roller 19 is set to $I_1$, the controller 29 determines current $I_2$ flowing from the contact board 21 to the ground from voltage and resistance and controls the high voltage power source 28 based on current $I_2$ to control $I_1$ and provide a constant goal current value of $$I_1-I_2=I_{out}$$

Therefore, the controller 29, shown in FIG. 1, includes a current detecting means for detecting current $I_1$, a setting means for setting a goal current value, and a transfer control means for controlling current $I_1$. Here, current $I_{out}$ is set to be that current which flows from the transfer belt 17 to the photosensitive drum 11 due to image transfer, by allowing the transfer belt 17 and all the members that contact the transfer belt 17 to electrically float. In addition, current $I_{out}$ is set, for example, to 50 μA.

Figure 3:
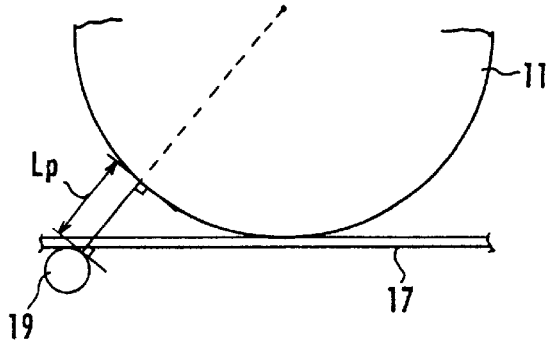
FIG. 3 is a schematic view showing part of the first embodiment.

In the first embodiment, as shown in FIG. 3, the transfer separator is constituted so that relations $Lp \geqq aV$, and $a=1$ mm/KV are established when a minimum distance between the image carrier 11 and a surface of the bias roller 19 is set to Lp (mm) and a maximum voltage applied to the bias roller 19 is set to V (KV).

Figure 5:
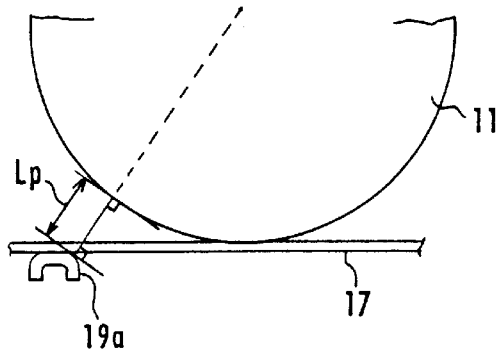
FIG. 5 is a view for explaining the first embodiment.
Figure 4:
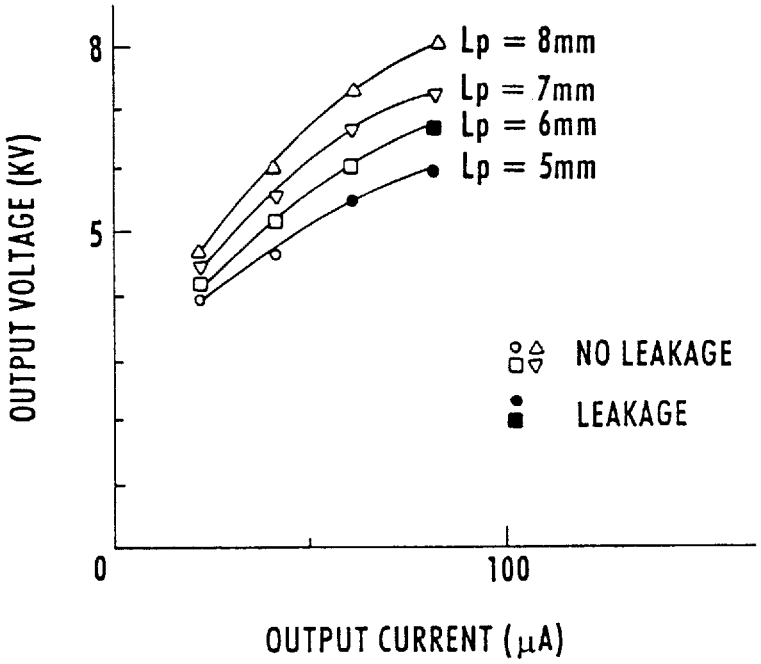
FIG. 4 is a view showing the results of experiment on the first embodiment.

The transfer bias voltage which is applied from the high voltage power source 28 to the bias roller 19 is set to −1 KV to −7 KV. When an experiment of the first embodiment is performed by changing Lp from 5 mm to 6 mm, 7 mm and 8 mm, the results shown in FIG. 4 are obtained. Here, the output voltage is outputted from the high voltage power source 28 to the bias roller 19 and the output current is outputted from the high voltage power source 28 to the bias roller 19. It is known that leakage (abnormal discharge) occurs from the transfer belt 17 to the image carrier 11 at a point where Lp exceeds aV. That is, when Lp is 5 mm, leakage does not occur while V is 5 KV or less, and when Lp is 6 mm, leakage does not occur while V is 6 KV or less. Also, when Lp is 7 mm, leakage does not occur while V is 7 KV or less, and when Lp is 8 mm, leakage does not occur while V is 8 KV or less. This phenomenon is the same even when pin holes are present on the image carrier 11 and even when the bias roller 19 is composed of a sheet metal 19*a*, as shown in FIG. 5. From this fact, in the first embodiment, where the line speed of the photosensitive drum 11 and the transfer belt 17 is set to 330 mm/sec, current is set as $I_{out}$=50 μA, the maximum voltage applied from the high voltage power source 28 to the bias roller 19 is set to 7 KV and Lp to 7 mm or more, and thereby leakage is controlled and transfer is performed favorably.

Figure 12:
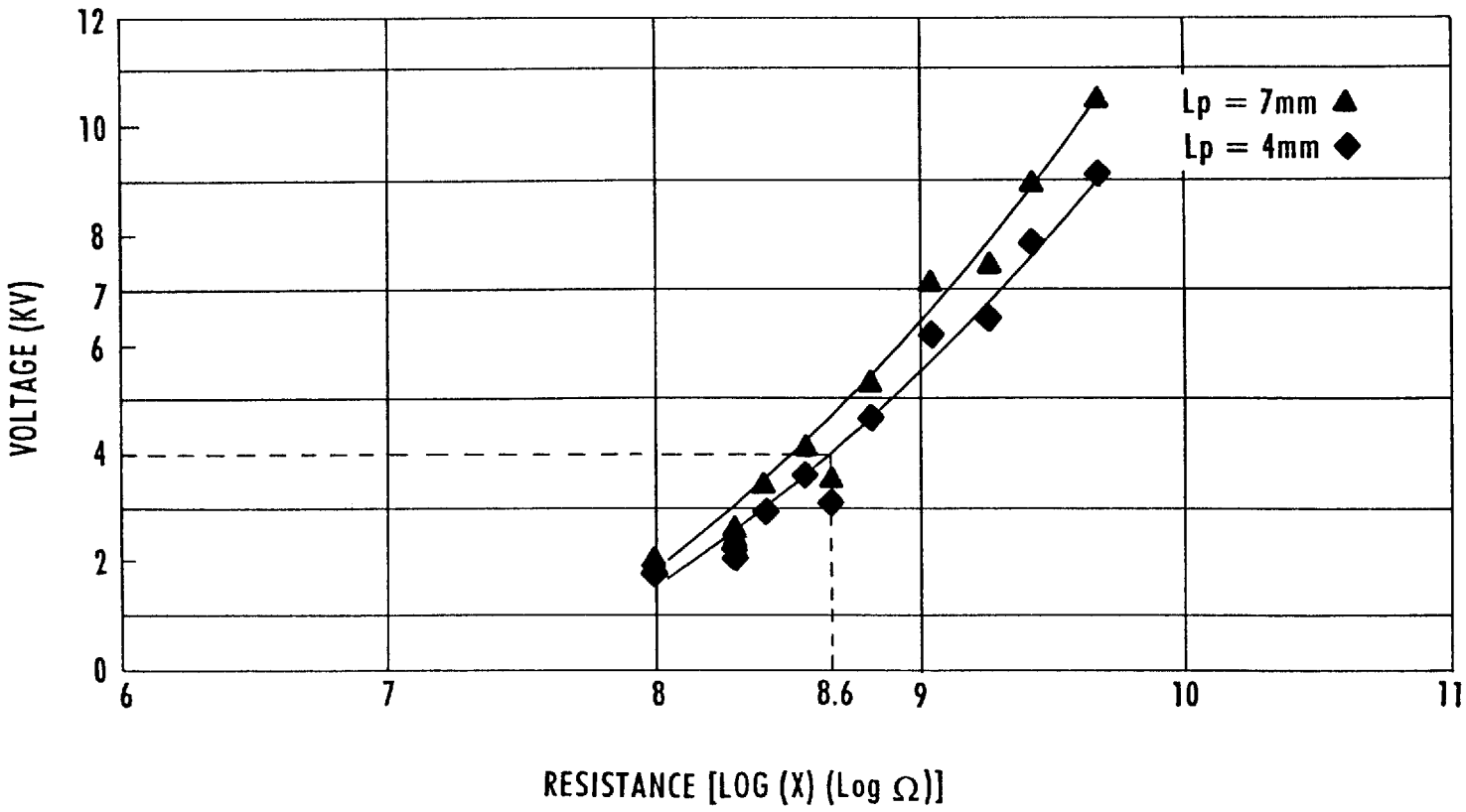
FIG. 12 is a characteristic view showing relations between resistance and applied voltage of the transfer belt in the first embodiment.

In addition, the maximum voltage V applied from the high voltage power source 28 to the bias roller 19 is determined as the predetermined limit voltage $V_L$, for example, by a limiter described later referring to FIG. 10. The relation between a surface resistivity of the transfer belt 17 and the applied voltage of the transfer belt 17 is established as shown in FIG. 12. In particular, when the surface resistivity of the inner surface of the transfer belt 17 contacting the bias roller 19 is set to a value around $10^9$ Ω/□ ($5\times10^8$ Ω/□ to $3\times10^9$ Ω/□) , the applied voltage of the transfer belt 17 increases along with the resistance of the transfer belt 17. The relation between the transfer belt 17 surface resistivity and the applied voltage of the transfer belt 17, shown in FIG. 12, is data in the standard conditions (23° C., 65%). However, since the applied voltage of the transfer belt 17 increases under the adjusted moisture or low temperature and low moisture conditions of the transfer paper, there is a variation of 0.5 to 1.0 KV.

The optimal resistance of the transfer belt 17 is $1\times10^7$ Ω/□ to $1\times10^9$ Ω/□ in the surface resistance of the rubber which is provided on the rear face of the transfer belt 17. However, as described above, the applied voltage of the transfer belt 17 increases along with the resistance of the transfer belt 17. When Lp is set to 4 mm, it is necessary to limit the resistance range of the transfer belt 17 to $4\times10^8$ Ω/□ because the rubber resistance reaches 4 KV in the vicinity of $4\times10^8$ Ω/□ to allow a danger of leakage. However, when Lp is set to 7 mm, the transfer belt 17 can be used until the rubber resistance becomes $1\times10^9$ Ω/□ and, since the applied voltage of the transfer belt 17 is set within the scope of the limit voltage $V_L$=7 KV, leakage occurs, and yet the transfer belt 17 can be used with a larger resistance range.

Figure 10:
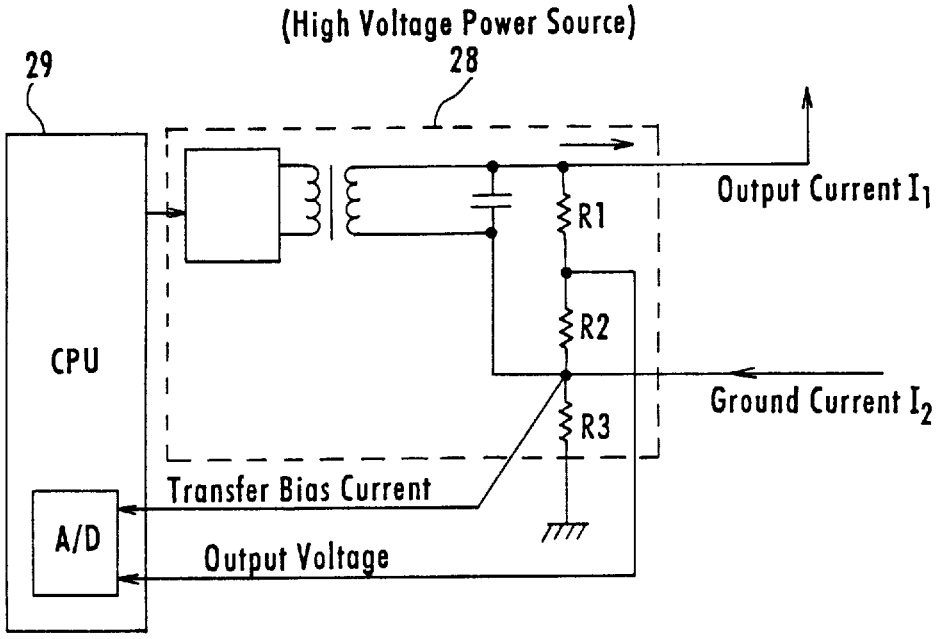
FIG. 10 is a circuit diagram showing part of the first embodiment.
Figure 11:
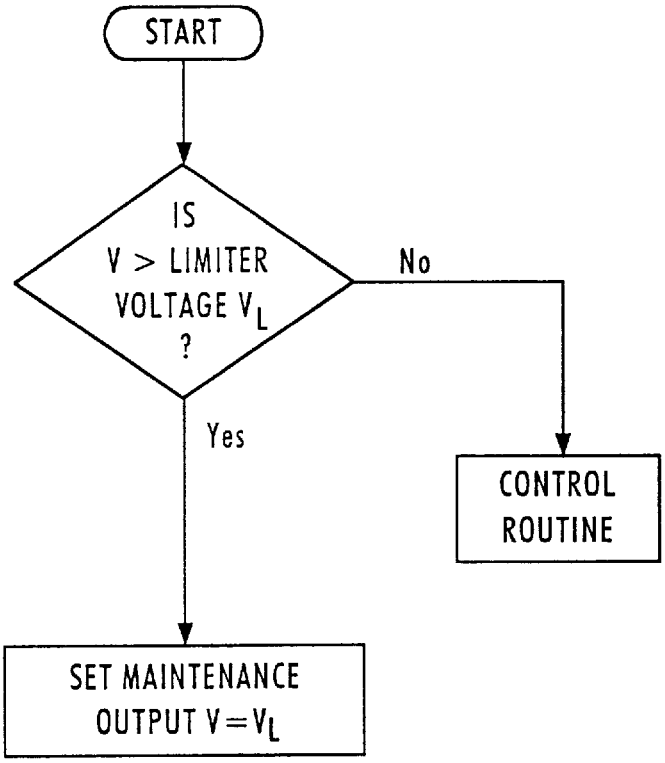
FIG. 11 is a flowchart for explaining the first embodiment.

Referring to FIG. 10, depicted is a limiter which determines the maximum voltage to be applied to the bias application electrode, such as a roller, as noted previously. In the limiter, which is part of the high voltage power source 28, the output voltage corresponding to transfer bias current Iout (the current flowing from transfer belt 17 to the photoconductive drum 11 due to image transfer, namely $(I_1-I_2)$) and the applied voltage to the bias roller, divided by resistance R1 and R2, are both inputted to the controller 29 which includes a CPU and an A/D converter together with conventional logic circuitry. The controller 29 is configured to determine if the applied voltage to the bias roller exceeds a predetermined voltage $V_L$. Referring to FIG. 11, if the applied voltage exceeds the predetermined voltage, the controller 29 outputs to the high voltage power source 28 a control signal to limit the output voltage to the predetermined voltage. Hence, the voltage applied to the bias roller is controlled to fall within the the predetermined voltage, in accord with an aspect of the invention.

The predetermined voltage is based on the shortest distance between the image carrier 11 and the surface of the bias roller 19 required for optimum transfer. For example, assuming that the radius of the image carrier is 50 mm and the distance Lp is set to be more than 7 mm, the predetermined maximum voltage is 7.0 KV. If the radius of the image carrier is 30 mm and the distance Lp is more than 6 mm, the predetermined maximum voltage is 6.0 KV.

When Lp is set to Lp 7 mm, the controller 29 prevents leakage by maintaining the output voltage from the high voltage power source 28 to the bias roller 19 at the limit voltage $V_L$ when the output voltage from the high voltage power source 28 to the bias roller 19 exceeds 7 KV. When the output voltage of the high voltage power source 28 reaches 7 KV, it is difficult to secure the condition $I_{out}$=50 $\mu$A but the transfer rate can be secured as $I_{out}$32 30 $\mu$A, so that in many cases the image quality can be secured even when the output voltage of the high voltage power source 28 reaches 7 KV. Here, the reason for setting the current to $I_{out}$=50 $\mu$A is to secure the image quality when the resistance of the transfer belt 17 is low. When the resistance of the transfer belt 17 is at a higher level, the current can be used up to a level of $I_{out}$=30 $\mu$A.

The first embodiment of the invention thus provides a transfer separator comprising a transfer belt 17 for carrying and conveying the sheet 12 which comprises a transfer paper, transferring a toner image on the image carrier 11 onto the sheet 12, and separating the sheet 12 from the image carrier 11. The bias application electrode 19 is arranged for applying a transfer bias to this transfer belt 17, wherein the relations Lp=aV, and a=1 mm/KV are established when the minimum distance between aforementioned image carrier 11 and the surface of aforementioned bias application electrode 19 is set to Lp (mm) and the maximum voltage applied to aforementioned bias application electrode 19 is set to V (KV), so that abnormal discharge from the transfer belt to the image carrier can be prevented.

In addition, in the first embodiment the maximum voltage V applied to bias application electrode 19 is determined by the limiter, so that abnormal discharge from the transfer belt to the image carrier can be surely prevented, and a wide range of resistance can be used for the transfer belt 17.

Figure 6:
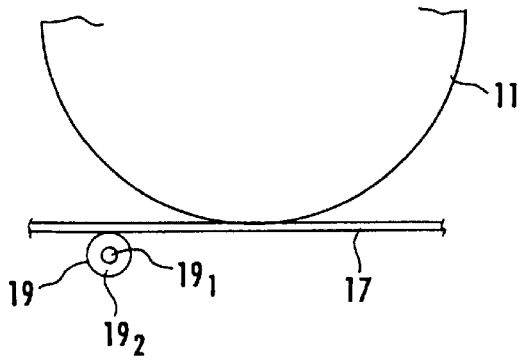
FIG. 6 is a schematic view showing part of a second embodiment of the present invention.

FIG. 6 shows part of the second embodiment of the present invention. Therein, a bias roller having the coating layer $\mathbf{19}_2$ composed of a medium resistance member on the core metal 19, is used as the bias roller 19 in the first embodiment and the difference in resistance between the coating layer $\mathbf{19}_2$ and the transfer belt 17 is set to be within two orders of magnitude.

Figure 7:
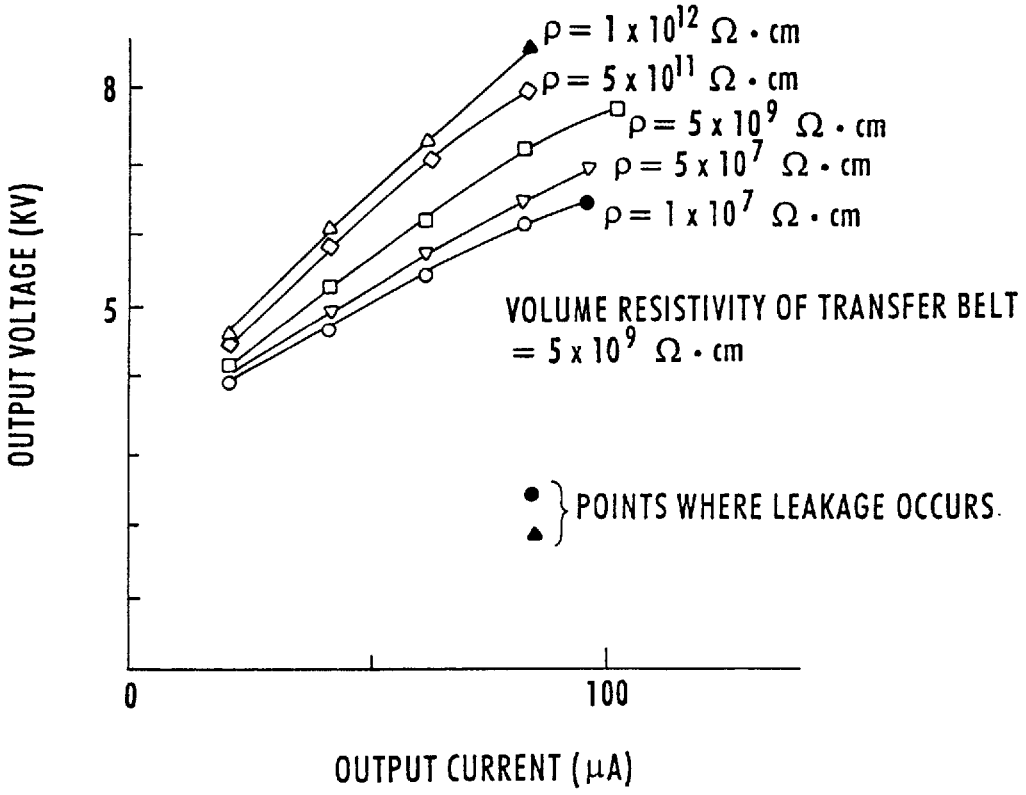
FIG. 7 is a view showing the results of an experiment on the second embodiment.

This second embodiment is tested using the bias roller 19, whose core metal $\mathbf{19}_1$ is coated with a 0.5 mm thick layer $\mathbf{19}_2$ which is made of urethane with dispersed carbon particles and whose volume resistivity is $1\times10^{12}$ Ω·cm, $5\times10^{11}$ Ω·cm, $5\times10^{9}$ Ω·cm, $5\times10^{7}$ Ω·cm, $1\times10^{7}$ Ω·cm respectively (namely, the thickness resistance between the core metal $\mathbf{19}_1$, and surface of the layer $\mathbf{19}_2$ is $5\times10^{10}$ Ω, $2.5\times10^{10}$ Ω, $2.5\times10^{8}$ Ω, $2.5\times10^{6}$ Ω, $5\times10^{5}$ Ω respectively) , and the transfer belt 17 whose volume resistivity is $5\times10^{9}$ Ω·cm (thickness is 0.5 mm and thickness resistance is $2.5\times10^{8}$ Ω). As shown in FIG. 7, leakage occurs when the volume resistivity of the coating layer $\mathbf{19}_2$ is $1\times10^{12}$ Ω·cm and $1\times10^{7}$ Ω·cm (thickness resistance is $5\times10^{10}$ Ω and $5\times10^{5}$ Ω respectively).

In addition, when the resistance of the coating layer $\mathbf{19}_2$ is higher than that of the transfer belt, the applied voltage of the transfer belt 17 increases and exceeds the pressure resistance of the transfer belt 17. On the other hand, when the resistance of the coating layer $\mathbf{19}_2$ is too low, the effect of the coating layer $\mathbf{19}_2$ is lost and leakage cannot be prevented. The bias roller 19 with the coating layer $\mathbf{19}_2$ whose thickness resistance is $2.5\times10^{8}$ Ω (volume resistivity is $5\times10^{9}$ Ω·cm) was most appropriate. It is preferable that the difference in thickness resistance between the coated layer for the bias roller and the transfer belt is within two orders of magnitude.

As a material to be used for the bias roller 19, rubber materials such as chloroburene rubber, an EPD rubber, a silicone rubber and an epichlorohydrin rubber, resin materials such as urethane resin and an ABS or blended materials thereof are considered. A conductive material such as carbon or the like is blended in the aforementioned materials to control their resistance values. In actuality, it seems that the thickness of the coating layer $\mathbf{19}_2$ of the bias roller 19 may be set to 0.1 to 5.0 mm.

In addition, in the second embodiment, the hardness of the coating layer $\mathbf{19}_2$ of the bias roller 19 is set to a level equal to or higher than that of the transfer belt 17. As the hardness of the transfer belt 17 is 63 degrees (JIS A), the hardness of the coating layer $\mathbf{19}_2$ of the bias roller 19 is set to 65 degrees. Also, when the hardness of the transfer belt 17 is 60 to 70 degrees, the hardness of the coating layer $\mathbf{19}_2$ of the bias roller 19 preferably be set to be equal to or higher than that, namely 60 to 90 degrees.

When the bias roller 19 uses a bias roller which has a coating layer $\mathbf{19}_2$ formed with a medium resistance material, such as an elastic rubber, and resin on a core metal $\mathbf{19}_1$, a transfer nip of the transfer belt 17 and the photosensitive drum 11 is formed by a roller (follower roller) on the input side of the transfer paper—and the bias roller 19—during transfer when the transfer belt 17 contacts the photosensitive drum 11. In order to stabilize this transfer nip, two rollers 19 and 20 which form the transfer nip must be fixed at stable positions and the transfer belt 17 must be pressed to the photosensitive drum 11 more strongly than its tension.

To produce such conditions, the follower roller 20 is usually made of metal. When the bias roller 19 is coated with a coating layer $\mathbf{19}_2$ having a medium resistance, as described above, there arises a problem that the coating layer $\mathbf{19}_2$ is deformed and the transfer nip becomes unstable. Thus, in the second embodiment, the problem is solved by setting the hardness of the coating layer $\mathbf{19}_2$ to a level equal to or higher than the hardness of the transfer belt 17.

Figure 8:
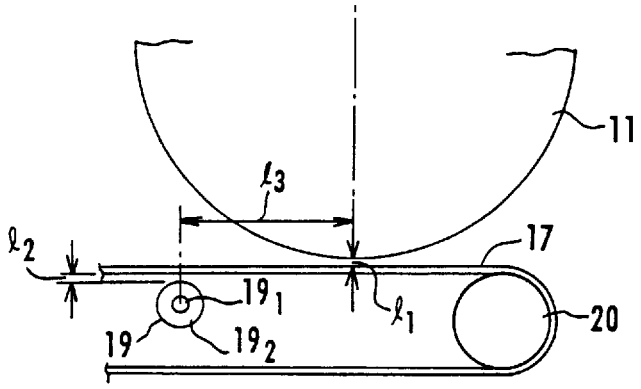
FIG. 8 is a schematic view showing a waiting state of part of the second embodiment.
Figure 9:
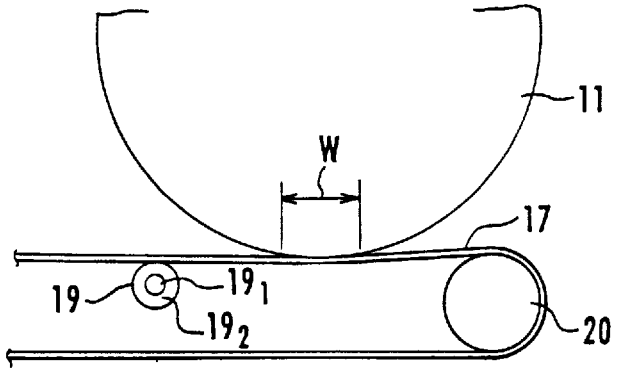
FIG. 9 is a schematic view showing a state of part of the second embodiment during transfer.

In addition, FIGS. 8 and 9 show a waiting state of part of the second embodiment and a transfer state thereof. In this second embodiment, there is provided a contact separating means for separating the transfer belt 17 except during transfer by allowing the bias roller 19 to contact the transfer belt 17 during transfer. As the contact separating means, a transfer belt raising means is used, which comprises the direct current solenoid 23 which is operated with a signal from controller 29 during transfer, and a push-up lever 24 which is driven by the direct current solenoid 23 to press the transfer belt 17 to the photosensitive drum 11.

During a waiting state as shown in FIG. 8, the distance $\mathbf{1}_1$ between the photosensitive drum 11 and the transfer belt 17 is set to 0.3 mm, the distance $\mathbf{1}_2$ between the transfer belt 17 and the bias roller 19 is set to 0.15 mm, and the distance $\mathbf{1}_3$ between a contact point of the photosensitive drum 11 and the transfer belt 17 and the bias roller 19 is set to 25 mm. The amount of push-up by the push-up lever 24 of the transfer belt is set to 0.5 mm during transfer, as shown in FIG. 9. Consequently, the width W of the transfer nip is set to 9 mm at the time of transfer, and at the same time, the bias roller 19 contacts the transfer belt 17 so that the transfer bias can be applied. With such a structure, the bias roller 19 does not contact the transfer belt 17 at the waiting time and contacts the transfer belt 17 only when applying the transfer bias.

When the bias roller 19 uses a roller which has a coating layer $\mathbf{19}_2$ which comprises a medium resistance member, such as an elastic rubber, resin or the like, on the core metal $\mathbf{19}_1$, materials such as plasticizer and oil are contained in the medium resistance rubber and resin. Thus, bleed occurs and the resistance value changes when the bias roller 19 contacts the transfer belt 17 having a similar medium resistance. In the second embodiment, since the bias roller 19 is separated from the transfer belt 17 except for transfer, it is possible to avoid a state in which the bias roller 19 and the transfer belt 17 contact each other in the waiting state when the transfer belt 17 remains static. Consequently, changes in the resistance value caused by bleed of the bias roller 19 can be prevented.

In this manner, the second embodiment provides a transfer separator comprising a transfer belt 17 for carrying the sheet 12 which comprises transfer paper, transferring a toner image on an image carrier 11 onto the sheet 12, and separating the sheet 12 from the image carrier; and a bias application electrode 19 for applying a transfer bias to this transfer belt 17. The bias application electrode 19 has the coating layer $\mathbf{19}_2$ which comprises a medium resistance member, and the difference in resistance between the coating layer $\mathbf{19}_2$ and the aforementioned transfer belt 17 is set to be within two orders of magnitude, so that abnormal discharge from the transfer belt to the image carrier can be prevented.

Further, in the second embodiment the hardness of the coating layer $\mathbf{19}_2$ of the bias application electrode 19 is set to be equal to or higher than the hardness of the transfer belt 17, so that a stable condition of the transfer nip can be secured.

Further, there is provided means for separating the bias application electrode 19 from the transfer belt 17 except for transfer, so that changes in resistance caused by the bleed of the bias application electrode can be prevented.

Incidentally, the present invention is not limited to the aforementioned embodiments and can be applied, for example, to a transfer separator in an image forming apparatus such as a facsimile machine, a printer or the like. In addition, the bias roller 19 may be formed with three or more layers and the outermost layer may be formed with aforementioned coating layer $\mathbf{19}_2$ .

Although the present invention has been described with reference to particular means, materials and embodiments, from the foregoing description one skilled in the art can easily ascertain the essential characteristics of the present invention and various changes and modifications may be made to adapt the various uses and characteristics without departing from the spirit and scope of the present invention as described by the claims that follow.

We claim:

1. A transfer separator comprising a transfer member for carrying a sheet for transferring a toner image from an image carrier to the sheet and then separating the sheet from the image carrier, and a bias application electrode for applying a transfer bias to the transfer member, wherein a relation of $Lp \geqq aV$, and $a=1$ mm/KV is established when the minimum distance between said image carrier and a surface of said bias application electrode is set to Lp (mm) and a maximum voltage applied to said bias application electrode is set to V (KV), wherein Lp is measured radially along a line extending from the center of said image carrier to the center of said bias application electrode.

2. A transfer separator according to claim 1, wherein the maximum voltage V applied to said bias application electrode is determined by a limiter.

3. A transfer separator according to claim 1, wherein said transfer member comprises a belt.

4. A transfer separator according to claim 1, wherein said bias application electrode comprises a roller.

5. A transfer separator according to claim 1, wherein said bias application electrode is positioned downstream of said image carrier.

6. A transfer separator according to claim 1, wherein said image carrier comprises a drum.

7. A transfer separator comprising a transfer member for carrying and conveying a sheet to transfer a toner image from an image carrier to the sheet and separating the sheet from the image carrier, and a bias application electrode for applying a transfer bias to the transfer member, wherein said bias application electrode has a coated layer, and a difference in thickness resistance between the coated layer and said transfer member is set less than a factor of two orders of magnitude.

8. A transfer separator according to claim 7, wherein the hardness of said coated layer is set to a hardness equal to or higher than the hardness of said transfer member.

9. A transfer separator according to claim 7, wherein means is provided for separating said bias application electrode from said transfer member other than during a transfer.

10. A transfer separator according to claim 7, wherein said transfer member comprises a drum.

11. An electrostatic image transfer apparatus, comprising:

a photoconductive drum upon which an electrostatic latent image is to be formed;

a toner dispenser for transferring a toner to said photoconductive drum;

a transfer separator comprising a transfer member for carrying a sheet for transferring a toner image from said drum to the sheet and then separating the sheet from the drum; and a bias application electrode for applying a transfer bias to the transfer member, wherein a relation of $Lp \geqq aV$, and $a=1$ mm/KV is established when the minimum distance between said drum and a surface of said bias application electrode is set to Lp (mm) and a maximum voltage applied to said bias application electrode is set to V (KV), wherein Lp is measured radially along a line extending from the center of said image carrier to the center of said bias application electrode.

12. An electrostatic image transfer apparatus according to claim 11, wherein said transfer member comprises a belt.

13. An electrostatic image transfer apparatus according to claim 11, wherein said bias application electrode is positioned downstream of said drum.

* * * * *

UNITED STATES PATENT AND TRADEMARK OFFICE

CERTIFICATE OF CORRECTION

PATENT NO. : 5,822,667
DATED : October 13, 1998
INVENTOR(S) : Yuko HAYAMA et al

It is certified that error appears in the above-indentified patent and that said Letters Patent is hereby corrected as shown below:

On the cover page under Inventors:
change "Kohoku-ku" to --Yokohama--;
change "Akabane-nishi" to --Tokyo--;
change "Bunkyo-ku" to --Tokyo--;
change "Miyamae-ku" -- should read --Kawasaki--.
change "Hakuti" to --Haruji--;
change "Shinjyuku-ku" to --Tokyo--;
change "Komatsubara" to --Sama--;
change "Itaku Matsuta" to --Itaru Matsuda--;
change "Izumi-ku" to --Yokohama--.

Signed and Sealed this
Fourth Day of May, 1999

*Attest:*

*Attesting Officer*

Q. TODD DICKINSON

*Acting Commissioner of Patents and Trademarks*